US006629681B1

(12) United States Patent
Miller et al.

(10) Patent No.: US 6,629,681 B1
(45) Date of Patent: Oct. 7, 2003

(54) FLEXIBLE FORM ASSEMBLY

(75) Inventors: Thomas E. Miller, Mequon, WI (US); Colin P. Miller, Denver, CO (US); Richard E. Doerfer, Cape Coral, FL (US); Erik C. Peterson, Milwaukee, WI (US)

(73) Assignee: Metal Forms Corporation, Milwaukee, WI (US)

( * ) Notice: Subject to any disclaimer, the term of this patent is extended or adjusted under 35 U.S.C. 154(b) by 0 days.

(21) Appl. No.: 09/507,552

(22) Filed: Feb. 18, 2000

(51) Int. Cl.[7] ..... E01C 7/00; E06B 1/20; E04G 11/00

(52) U.S. Cl. ..... 249/3; 249/2; 249/6; 249/7; 249/13; 249/207; 52/85; 52/245; 404/98

(58) Field of Search ..... 249/2–9, 189, 249/DIG. 3; 52/85, 245; 404/96, 98

(56) References Cited

U.S. PATENT DOCUMENTS

| | | | | |
|---|---|---|---|---|
| 1,037,907 A | | 9/1912 | Heltzel | |
| 1,459,207 A | | 6/1923 | Heltzel | |
| 1,739,254 A | | 12/1929 | Mosel | |
| 2,661,516 A | * | 12/1953 | Yates | 246/6 |
| 2,663,925 A | * | 12/1953 | Yates | 249/6 |
| 2,731,700 A | | 1/1956 | Yates | |
| 2,799,072 A | | 7/1957 | Grundy | |
| 2,846,749 A | | 8/1958 | Yates et al. | |
| 4,321,024 A | | 3/1982 | Terraillon | |
| 4,340,200 A | | 7/1982 | Stegmeier | |
| 4,411,404 A | | 10/1983 | Weisbach | |
| 4,540,309 A | * | 9/1985 | Hansson | 403/374 |
| 4,579,312 A | | 4/1986 | White | |
| 4,712,764 A | | 12/1987 | White | |
| 5,015,117 A | | 5/1991 | Pawlicki | |
| 5,154,837 A | | 10/1992 | Jones | |
| 5,205,942 A | | 4/1993 | Fitzgerald | |
| 5,261,635 A | * | 11/1993 | Flathau | 249/7 |
| 5,332,191 A | | 7/1994 | Nolan | |
| 5,492,303 A | | 2/1996 | Jaruzel | |
| 5,830,378 A | * | 11/1998 | Butler | 249/3 X |
| 6,021,994 A | | 2/2000 | Shartzer, Jr. | |
| 6,173,937 B1 | * | 1/2001 | Cottongim | 249/192 |

FOREIGN PATENT DOCUMENTS

| | | | | |
|---|---|---|---|---|
| GB | 2036155 | * | 6/1980 | 249/2 |

OTHER PUBLICATIONS

Brochure entitled: "PlastiForm" by The Plastiform Company. Undated.

Brochure entitled: "Speed Screed Solo One–Man Power Screed" by Metal Forms Corporation. Undated.

* cited by examiner

*Primary Examiner*—Jong-Suk (James) Lee
(74) *Attorney, Agent, or Firm*—Sonnenschein Nath & Rosenthal LLP

(57) ABSTRACT

A flexible form assembly for forming concrete structures during setting of the concrete is provided. The flexible form assembly includes an elongated form having a front side for engaging the concrete and a rear side. The rear side includes a back wall disposed between two rearwardly extending top and bottom walls which, in turn, are connected to downwardly and upwardly protruding lips respectively to form a C-shaped pocket for receiving a stake holder. The stake holder includes right and left flanges that abuttingly engage the back wall and that fit between the top and bottom walls and that are partially disposed between the upper and lower lips and the back wall. The stake holder further comprises a pocket portion that is connected to and disposed between right and left flanges. The pocket portion extends outwardly to define an apex which provides a looped pocket for receiving a stake. The stake holder can be configured to slide along the C-shaped pocket of the form for easy adjustment or can fit in the C-shaped pocket in a tight frictional engagement to provide a stake holder with a fixed position with respect to the form.

20 Claims, 6 Drawing Sheets

FLEXIBLE FORM ASSEMBLY

FIELD OF THE INVENTION

The present invention relates generally to forms used for pouring concrete structures and, more specifically, to a flexible form assembly that may be used for pouring concrete structures of varying shapes. Still more specifically, the present invention relates to strike-off rods for concrete finishings and rods or bars used for power or manual screeding. Further, the present invention relates to means for connecting flexible forms used for pouring concrete structures.

BACKGROUND OF THE INVENTION

Flexible forms are often used for the purpose of pouring concrete structures such as curbs, walls, sidewalks or other structures of varying shapes. Typically, flexible and rigid sheet metal forms or wooden forms are used and, more recently, plastic forms have been employed.

However, wooden forms are not preferred because they are generally not useable and are difficult to use due to their lack of flexibility. Sheet metal forms, on the other hand, are flexible but are expensive and difficult to handle when pouring concrete structures of varying shapes. When pouring concrete structures with extreme changes in contour or shape, it has been found that wooden or sheet metal forms are impractical.

To remedy the deficiencies of sheet metal and wooden forms, plastic forms have been employed. One such system is sold under the PLASTIFORM™ trademark by the Plastiform Company of 14114 SE 162 Pl., Renton, Wash. 98058. However, these currently-available plastic form assemblies are problematic for a number of reasons. First, the PLASTIFORM™ assemblies are provided with nylon clamps that clamp the plastic form to a stake that has already been driven into the ground. Because the stake must be driven into the ground prior to being clamped to the form, there is no means for easily adjusting the position of the stake with respect to the form. Second, in order to connect two adjoining forms together, two end caps are required. If the end caps become lost or misplaced, there is no other way to connect two adjoining plastic forms.

Accordingly, there is a need for an improved flexible form assembly that provides the benefits of lightweight plastic forms but which enables the form to be reinforceable or made more rigid for straight line work. Further, there is a need for an improved flexible form assembly which provides for improved stake pockets which provides both fixed stake pockets or slidable stake pockets. Still further, there is a need for an improved flexible form assembly which provides for a variety of means for connecting two adjoining plastic forms together, such as hinge arrangements or the use of stake pockets to connect two forms together in addition to the use of end caps.

SUMMARY OF THE INVENTION

The aforenoted needs are satisfied by the present invention which provides an improved flexible form assembly. The flexible form assembly of the present invention includes an improved form design which enables the plastic forms to be easily and conveniently reinforceable. The present invention also provides an improved slidable stake pocket design which enables the position of the stake pocket along the form to be easily adjusted. Further, the design of the slidable stake pocket is also flexible thereby permitting the slidable stake pocket to be utilized along a curved structure. The present invention also provides an improved fixed stake pocket design that is also flexible for use along curved structures. Still further, the present invention provides an improved stake pocket design for connecting two plastic forms, one on top of the other, to provide a heightened surface for forming. The present invention also provides an improved end cap design and hinge mechanisms for connecting one end of a form to an end of an adjoining form. Finally, the present invention provides an improved lightweight form that can be used as a strike-off for concrete finishing or for power or manual screeding.

In an embodiment, the present invention provides a flexible form assembly for forming a concrete structure during drying of the concrete. The flexible form assembly comprises an elongated form that comprises a front side for engaging the concrete and a rear side. The rear side comprises a back wall disposed between rearwardly extending top and bottom walls. The top wall is connected to a downwardly protruding upper lip. The bottom wall is connected to an upwardly protruding lower lip. The upper and lower lips, the top and bottom walls and the back wall form a C-shaped pocket for receiving a stake holder. The stake holder comprises right and left flanges that abuttingly engage the back wall, that fit between the top and bottom walls and that are partially disposed between the upper and lower lips and the back wall. The stakeholder further comprises a pocket portion that is connected to and disposed between the right and left flanges. The pocket portion extends outward rearwardly to define an apex which provides a looped pocket for receiving a stake.

In an embodiment, the front side of the form comprises a front wall that is spaced apart from the back wall and the front and back walls define a pocket for receiving at least one aluminum reinforcing tube.

In an embodiment, the front side of the form comprises a front wall that is spaced apart from the back wall. The front and back walls are connected by top and bottom horizontal walls. The front and back walls and top and bottom horizontal walls define a pocket for receiving at least one aluminum reinforcing tube.

In an embodiment, the front and back walls are also connected by a middle horizontal wall that is disposed between the top and bottom horizontal walls. The top and middle horizontal walls define a pocket for receiving a first aluminum reinforcing tube. The bottom and middle horizontal walls define a pocket for receiving a second aluminum reinforcing tube.

In an embodiment, the front wall is connected to top and bottom front ledges disposed between the top and bottom horizontal walls. The back wall is connected to top and bottom back ledges disposed between the top and bottom horizontal walls. The top front ledge is parallel to and extending towards the top back ledge. The bottom front ledge is parallel to and directed towards the bottom back ledge. The top horizontal wall, the top front ledge and the top back ledge define a pocket for receiving a first aluminum reinforcing tube. The bottom horizontal wall, the bottom front ledge and the bottom back ledge define a pocket for receiving a second aluminum reinforcing tube.

In an embodiment, the pocket portion flexibly connects the left flange to the right flange.

In an embodiment, the right and left flanges are slidably received between the upper and lower lips and the back wall.

In an embodiment, the left flange comprises a vertical leg that is connected to the pocket portion and a horizontal leg that extends parallel to the pocket portion and in a spaced apart relationship with the pocket portion. The right flange comprises a vertical leg that is connected to the pocket portion and a horizontal leg that extends parallel to the pocket portion and in a spaced apart relationship with the pocket portion. The horizontal leg of the right flange is disposed opposite the pocket portion from the horizontal leg of the left flange. The horizontal legs of the right and left flanges are biased towards the pocket portion as they frictionally engage the top and bottom walls of the rear side of the form.

In an embodiment, the horizontal leg of the left flange comprises a tapered distal end directed towards a tapered distal end of the vertical leg of the right flange and the horizontal leg of the right flange comprises a tapered distal end directed towards a tapered distal end of the vertical leg of the left flange.

In an embodiment, the pocket portion flexibly connects the horizontal leg of the left flange to the horizontal leg of the right flange.

In an embodiment, the present invention provides a flexible form assembly for forming a concrete structure during drying of the concrete. The flexible form assembly comprises top and bottom elongated forms. Each elongated form comprises a front side for engaging the concrete and a rear side. The rear side of each form comprises a back wall disposed between rearwardly extending top and bottom walls. The top wall of each form is connected to a downwardly protruding upper lip. The bottom wall of each form is connected to an upwardly protruding lower lip. The upper and lower lips, the top and bottom walls and the back wall of each form forming a C-shaped pocket for receiving a portion of a stake holder. The top form is stacked on the bottom form so that the front side of the top form is disposed above and flush with respect to the front side of the bottom form. The stake holder comprisesan upper portion for slidable connection to the C-shaped pocket of the top form and a lower portion for slidable connection to the C-shaped pocket of the bottom form. The upper and lower portions of the stakeholder each comprise right and left flanges that abuttingly engage the back wall of their respective form, that fit between the top and bottom walls of their respective form and that are partially disposed between the upper and lower lips and the back wall of their respective form. The upper and lower portions of the stakeholder each comprise a pocket portion that is connected to and disposed between its respective right and left flanges. Each pocket portion extends outward rearwardly to define an apex which provides a looped pocket for receiving a stake. The pocket portion of upper portion of the stakeholder is in alignment with and connected to the pocket portion of the lower portion of the stakeholder.

In an embodiment, the present provides a flexible form assembly for forming a concrete structure during drying of the concrete. The flexible form assembly comprises an elongated first form and an elongated second form. Each form comprising a front side for engaging the concrete and a rear side. The rear side of each form comprises a back wall disposed between rearwardly extending top and bottom walls. The top wall of each form is connected to a downwardly protruding upper lip. The bottom wall of each form is connected to an upwardly protruding lower lip. The upper and lower lips, the top and bottom walls and the back wall of each form forming a C-shaped pocket for receiving a connection mechanism. The front side of the each form also comprises a front wall that is spaced apart from the back wall. The front and back walls of each form being connected by a horizontal wall. Each form also having an open end. The connection mechanism connecting the open end of the first form to the open end of the second form.

In an embodiment, the connection mechanism comprises a first end plug and a second end plug. The first end plug mateably engages the open end of the first form. The second end plug mateably engages the open end of the second form. The first end plug comprises an outwardly protruding post and an outwardly protruding cleat. The second end plug comprises a hole for mateably receiving the post of the first end plug and an elongated slot for mateably receiving the cleat of the first end plug.

In an embodiment, the cleat comprises a narrow shaft portion connected to a distal end having an enlarged head and the elongated slot comprises and enlarged portion for receiving the enlarged head of the cleat and a narrower portion for receiving the shaft portion of the cleat and trapping the enlarged head of the cleat behind the second end plug.

In an embodiment, the connection mechanism comprises a plastic living hinge that is received in the C-shaped pockets of the first and second forms.

In an embodiment, the connection mechanism comprises a hinge comprising a first plate that is received in the C-shaped pocket of the first form and a second plate that is received in the C-shaped pocket of the second form. The first and second plates are hingedly connected together.

These and other objects and advantages of the present invention will become apparent upon reading the following detailed description and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
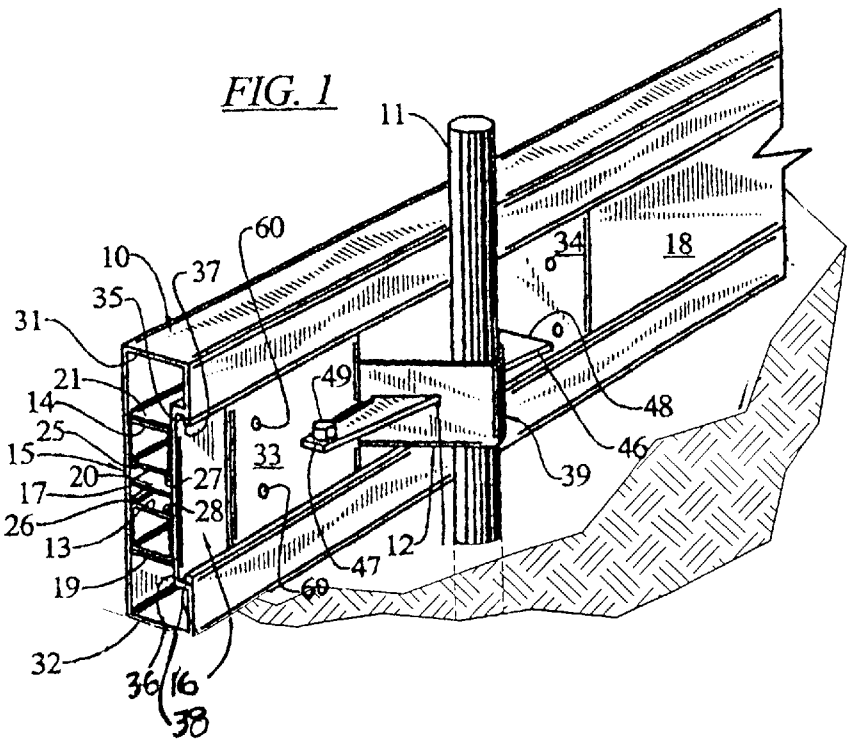
FIG. 1 is a perspective view of a flexible form, slidable pocket, stake and reinforcing tubular rods made in accordance with the present invention.

Turning first to FIG. 1, a form 10 is illustrated as connected to a stake 11 by a slidable stake pocket 12. The form 10 has also been reinforced with two tubular reinforcing rods 13, 14.

Figure 9:
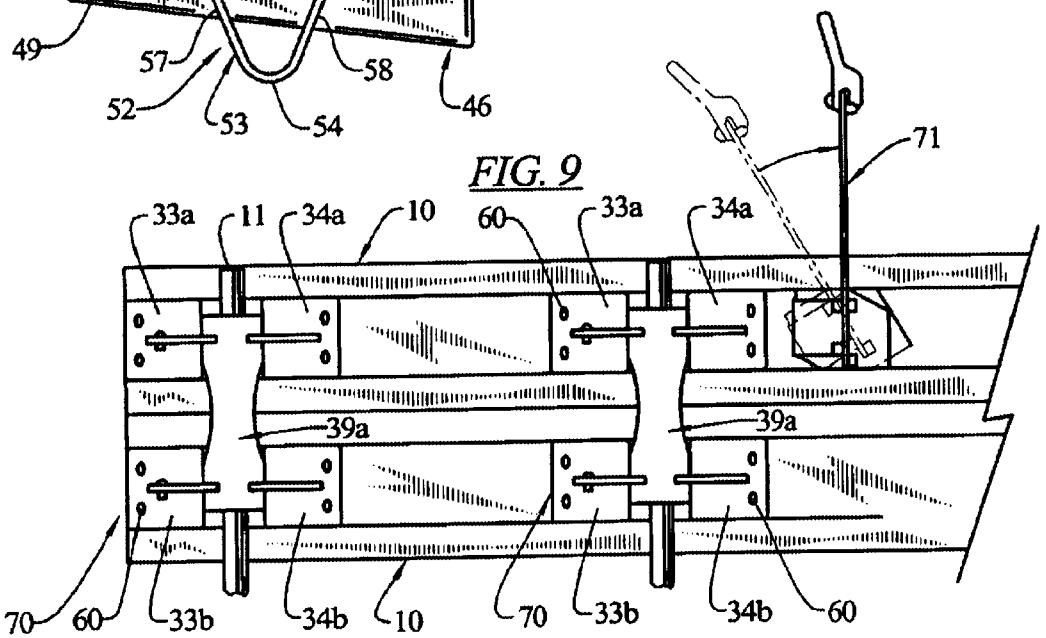
FIG. 9 illustrates another embodiment of the present invention which includes two forms stacked one on top of the other and connected by sliding stake pockets, as well as the installment of a hanger for connecting the two forms shown in FIG. 9 with a third form (not shown)
Figure 10:
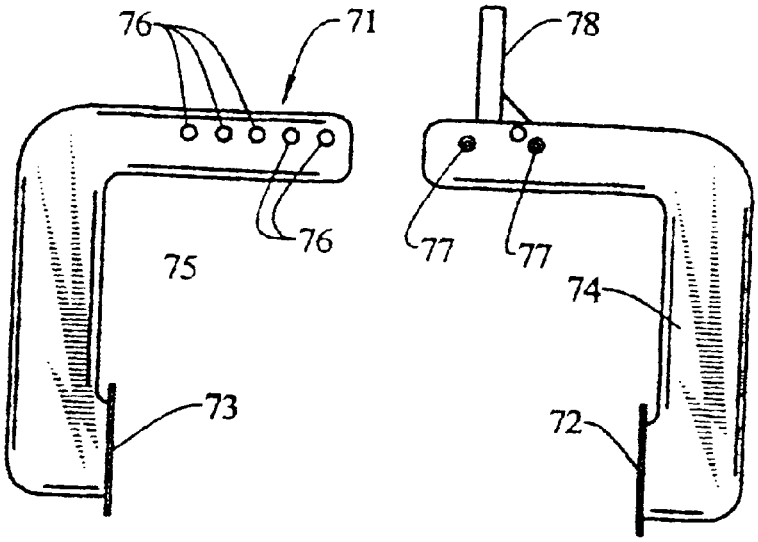
FIG. 10 is an exploded view of the hanger shown in FIG. 9.
Figure 11:
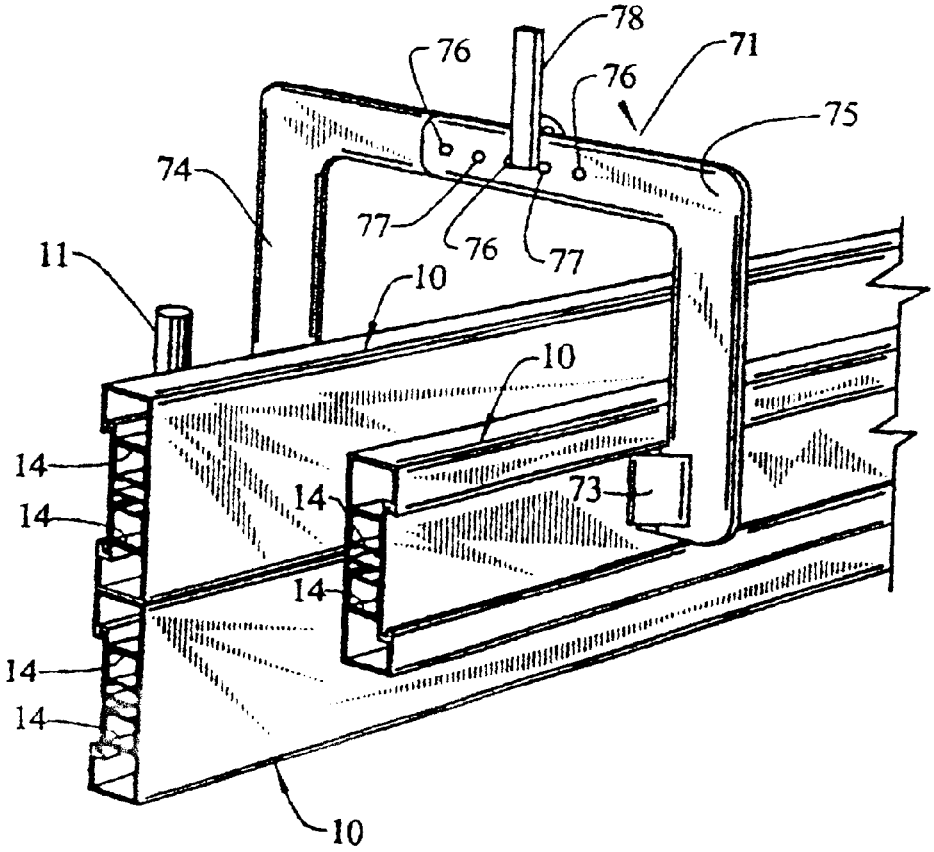
FIG. 11 is a perspective view of the hanger shown in FIGS. 9 and 10 as installed on three forms, two of which are connected together in the manner illustrated in FIG. 9.

The flexible form 10 includes a front side 15 which engages the concrete and a rear side 16 which is used for connecting the form 10 to a stake, such as 11 or to another form as shown in FIGS. 9 and 11 or to a hanger, also shown in FIGS. 9 and 11. The front side 15 includes a front wall 17 which is spaced apart from the rear wall 18 by one or more horizontal walls 19, 20, 21. The spacing between the front wall 17 and the rear wall 18 provides for a sufficient pocket or spacing so as to enable the form 10 to be reinforced with the hollow tubular rods shown at 13, 14. In a preferred embodiment, the tubes or rods 13, 14 are fabricated from aluminum because they are stiff, light and resistant to warping. Also in a preferred embodiment, the flexible form 10 is fabricated from high density polyethylene because of its stiffness and resistance to swelling when exposed to water.

In the embodiment illustrated in FIG. 1, the front wall 17 is connected to top and bottom ledges 25, 26 and the rear wall 18 is similarly connected to top and bottom ledges 27, 28. The top ledges 25, 27 and the top horizontal wall 21 form a pocket for receiving the aluminum tube 14.

It will be noted that the flexible form 10 has a C-shaped cross section for receiving the left and right flanges 33, 34 of the slidable stake pocket 12. Specifically, the C-shaped cross section is defined by the rear wall 18, the top and bottom walls 35, 36, the downwardly protruding lip 37 and the upwardly protruding lip 38. The C-shaped pocket formed by the rear wall 18, the bottom and top walls 35, 36 and the downwardly and upwardly protruding lips 37, 38 slidably receives the flanges 33, 34 of the slidable stake pocket assembly 12.

Figure 2:
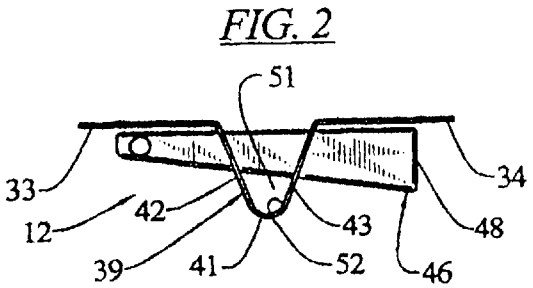
FIG. 2 is a top plan view of the slidable stake pocket shown in FIG. 1.
Figure 3:
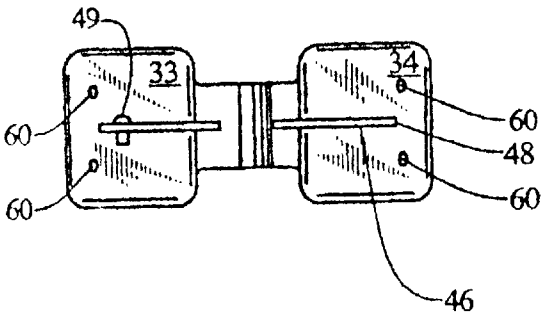
FIG. 3 is a front plan view of the slidable stake pocket shown in FIG. 1.
Figure 4:
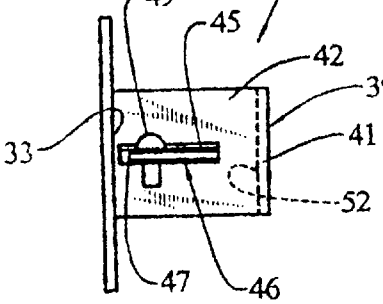
FIG. 4 is a side plan view of the slidable stake pocket shown in FIG. 1.
Figure 5:
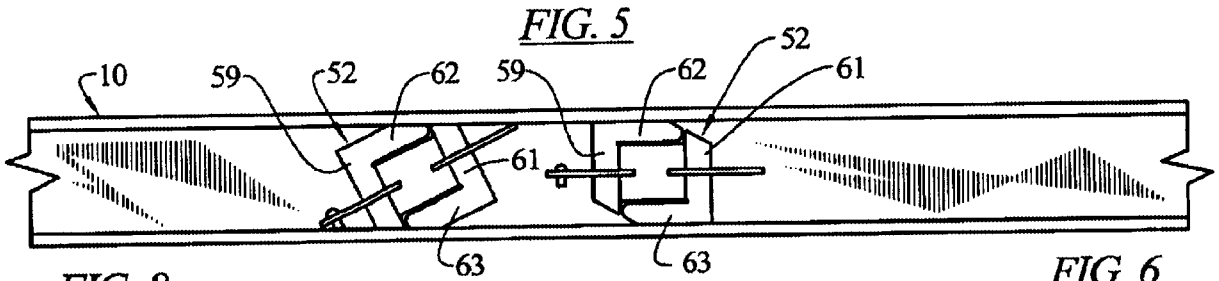
FIG. 5 is a plan view illustrating the installment of a fixed pocket in a flexible form made in accordance with the present invention.

Turning to FIGS. 2–4, the slidable stake pocket assembly 12 includes a V-shaped pocket portion 39 which includes an apex 41 that is connected to the left and right flanges 33, 34 respectively by the angled side walls 42, 43. The angled side walls 42, 43 each comprise a slot such as the slot 45 shown in FIGS. 1 and 4 for receiving the angled wedge 46. The wedge 46 includes a narrow front end 47 and a wider rear end 48. The narrow front end 47 includes a retainer 49 which precludes removal of the wedge 46 from the pocket portion 39. After the stake 11 is inserted through the opening 51 defined by the pocket portion 39, force is applied to the rear end 48 of the wedge 46 to secure the position of the stake 11 against the inside surface 52 of the apex 41.

Figure 6:
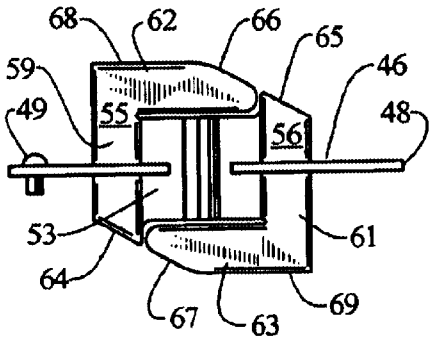
FIG. 6 is a front plan view of the fixed pocket shown in FIG. 5.
Figure 7:
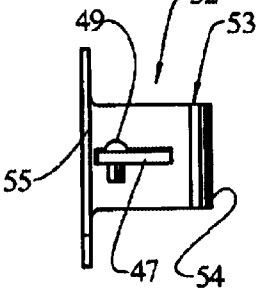
FIG. 7 is a side plan view of the fixed pocket shown in FIG. 5.
Figure 8:
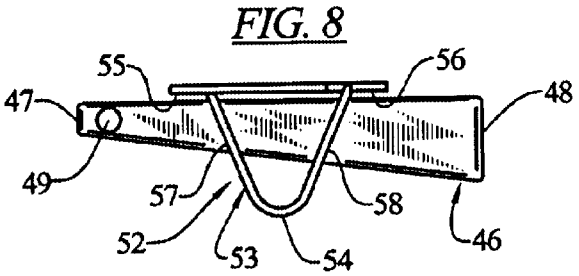
FIG. 8 is a top plan view of the fixed pocket shown in FIG. 5.

In addition to the slidable pocket assembly 12 illustrated in FIGS. 1–4, the present invention also provides for a fixed pocket assembly 52 illustrated in FIGS. 5–8. Specifically, the fixed pocket assembly 52 also includes a V-shaped pocket portion 53 that includes an apex 54 connected to left and right flanges 55, 56 by angled side walls 57, 58. Each flange 55, 56 includes a vertical leg portion 59, 61 respectively which is connected to the pocket portion 53. The vertical leg portions 59, 61 are, in turn, connected to horizontal leg portions 62, 63 respectively. The horizontal leg portions 62, 63 do not directly engage the pocket portion 53 as illustrated in FIG. 6 but, instead, are connected indirectly to the pocket portion 53 by the vertical leg portions 59, 61 respectively. The vertical leg portions 59, 61 each include a tapered distal end 64, 65 respectively. The tapered distal ends 64, 65 are in alignment with the tapered distal ends 66, 67 of the horizontal legs 62, 63 respectively. As a result, each pair of tapered ends 64, 67 and 65, 66 form an angled corner section which enables the pocket assembly 52 to be received in the form 10 as shown at the left in FIG. 5. The angled corner 64, 67 and 65, 66 enable a twisting of the assembly 52 to result in the assembly 52 assuming the position is shown at the right in FIG. 5. Thus, the pocket assembly 52 can be twisted into position. The assembly 52 is sized so that the upper and lower edges 68, 69 frictionally engage the upper and lower walls 35, 36 (not shown in FIG. 5; see FIG. 1) of the form 10 to secure the pocket assembly 52 in a fixed and not slidable position. The pocket assembly 52 uses the wedge 46 illustrated in FIGS. 1–4 in the manner described above.

Turning to FIG. 9, it will be noted that two forms 10 may be stacked on top of each other to provide a wider surface for engaging the unhardened concrete. If this technique is employed, a modified version of the slidable pocket assembly 12 can be utilized as illustrated by the pocket assembly 70 illustrated in FIG. 9. Specifically, a modified pocket portion 39*a* is connected to an upper set of flanges 33*a*, 34*a* as well as a lower set of flanges 33*b*, 34*b* which, in turn, are received in the C-shaped pockets provided by the forms 10 as illustrated in FIG. 1.

Figure 12:
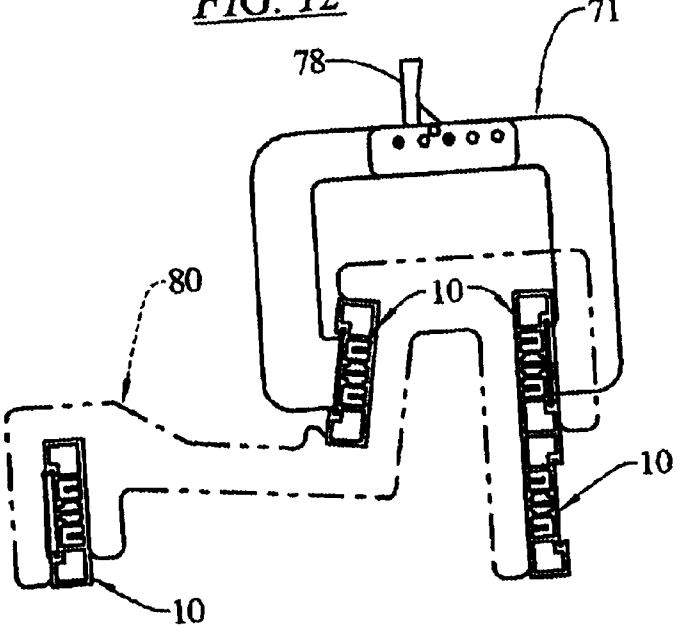
FIG. 12 is a front plan view illustrating the installment of the hanger and forms shown in FIG. 11 on a division plate.
Figure 14:
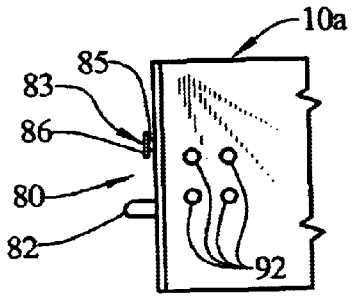
FIG. 14 illustrates an end of a form made in accordance with the present invention with an end cap installed thereon.
Figure 15:
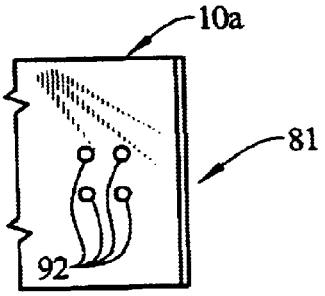
FIG. 15 illustrates an end of a form made in accordance with the present invention with an end cap installed thereon.
Figure 16:
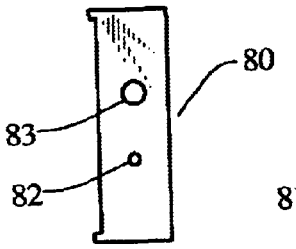
FIG. 16 is a front plan view of the end cap shown in FIG. 14.
Figure 17:
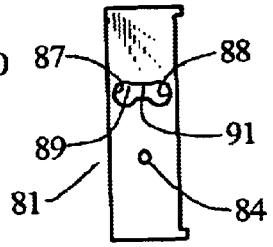
FIG. 17 is a front plan view of the end cap shown in FIG. 15.

FIG. 9 also illustrates the use of a hanger 71 which connects the double form structure shown in FIG. 9 to a third form 10 shown in FIG. 11 which is spaced apart from the two stacked forms 10. The hanger 71 is connected to the forms 10 by way of the flanges shown at 72, 73. The flanges are similarly received into the C-shaped pocket provided by the forms 10 by twisting the hanger 71 into place as illustrated in FIG. 9. The two halves 74, 75 of the hanger are adjustably connected together by way of the plurality of holes shown at 76 which receive the studs shown at 77. A handle is provided at 78. FIG. 12 illustrates the use of a hanger 71 in conjunction with a division plate 80 which is used to provide a seam in the concrete structure.

Figure 13:
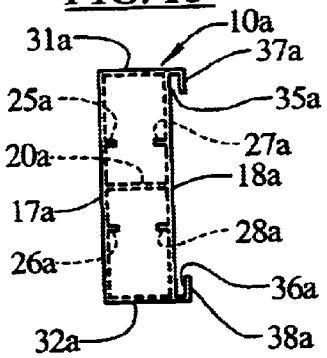
FIG. 13 is an end view of a flexible form made in accordance with the present invention.

FIG. 13 illustrates a cross section of a form 10*a* that has different dimensions than the form 10 illustrated previously. Specifically, the cross section illustrated for the form 10*a* is preferably used for a four inch form, or a form with a front wall 17*a* that is four inches high while the cross section for the form 10 is preferably utilized for a form with a front wall 17 that is six inches high. Aluminum tubes 14 (not shown in FIG. 13) may be inserted into the space defined by the upper wall 31*a* and ledges 25*a*, 27*a* as well as the space defined by the lower wall 32*a* and ledges 26*a*, 28*a*.

Figure 18:
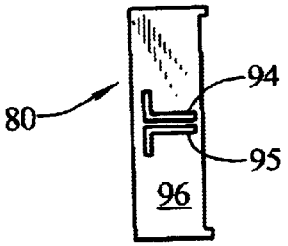
FIG. 18 is a rear plan view of the end cap shown in FIGS. 14 and 16.
Figure 20:
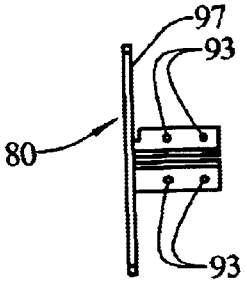
FIG. 20 is a side plan view of the end cap shown in FIGS. 15, 17 and 19.
Figure 19:
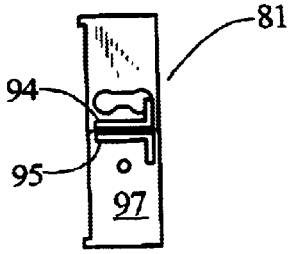
FIG. 19 is a rear plan view of the end cap shown in FIGS. 15 and 17.

The present invention also provides the improved means for connecting two adjacent forms together in an end-to-end fashion. Specifically, FIGS. 14–17 illustrate the employment of end caps 80, 81 made in accordance with the present invention and disposed in the ends of the forms 10*a* as shown in FIG. 13 or the forms 10 as shown in FIGS. 1–12. The end cap or plug 80 includes an outwardly protruding post 82 and an outwardly protruding cleat 83. The post 82 is received in the hole 84 of the end plug 81. The cleat 83 includes a narrow shaft portion 85 and an enlarged head portion 86. The enlarged head portion 86 can be received in either end 87, 88 of the slot 89 of the end plug 81. Pivotal movement of the two forms with respect to each other results in the narrow shaft portion 85 being received in the narrower portion 91 of the slot 89. If the end caps 80, 81 are to be employed, holes 92 can be provided in the forms 10*a*. The holes 92 are then aligned with the holes 93 in the L-shaped brackets 94, 95 that project inward from the inside surface 96 of the end plug 80 as shown in FIG. 18 or the inside surface 97 of the end plug 81 as shown in FIGS. 19 and 20. The brackets 94, 95 are disposed on either side of the middle horizontal wall 20*a* as shown in FIG. 13.

Figure 23:
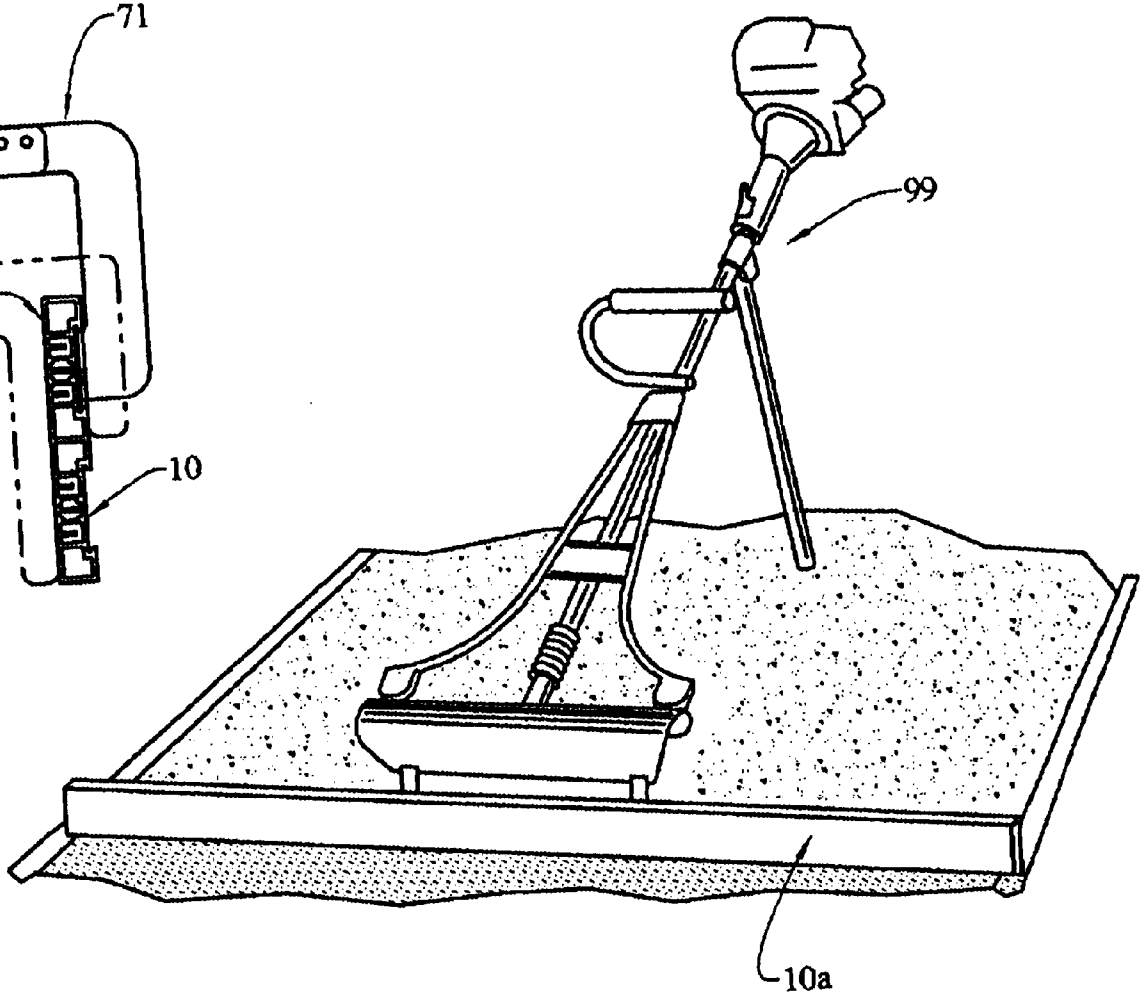
FIG. 23 is a perspective view of a form made in accordance with the present invention as installed on a power screeder.
Figure 21:
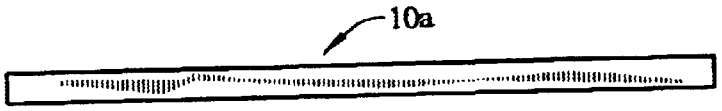
FIG. 21 is a top plan view of a flexible form made in accordance with the present invention equipped with two opposing end caps which can be used as a strike-off.
Figure 22:
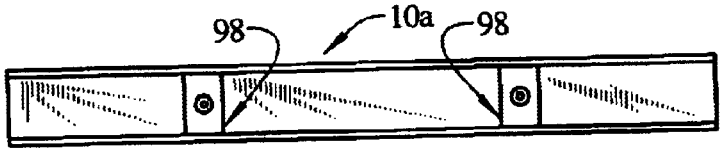
FIG. 22 illustrates a flexible form made in accordance with the present invention as equipped with two end caps and which can be employed for manual or power screeding.
Figure 27:
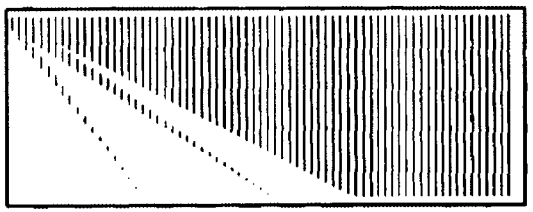
FIG. 27 is a plan view of a living hinge connector made in accordance with the present invention for connecting two adjoining flexible forms made in accordance with the present invention.
Figure 28:
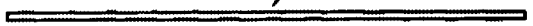
FIG. 28 is a side view of the hinge illustrated in FIG. 27.

FIG. 21 illustrates the use of a form 10*a* as a strike off for cement finishing. FIG. 22 illustrates the use of a form 10*a* equipped with attachment brackets 98 for connecting the form 10*a* to a power screed 99 as illustrated in FIG. 23.

Figure 24:
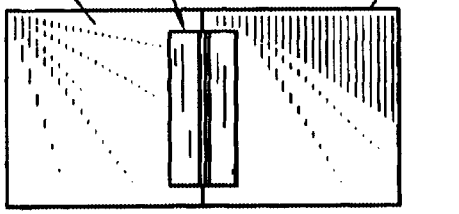
FIG. 24 is a plan view of a hinge made in accordance with the present invention for connecting two adjoining forms made in accordance with the present invention.
Figure 25:
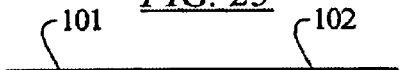
FIG. 25 is a side view of the hinge shown in FIG. 24.
Figure 26:
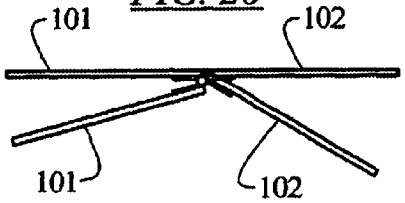
FIG. 26 illustrates the hinge connection provided to two adjoining forms with the hinge connection illustrated in FIGS. 24 and 25.

FIGS. 24–29 illustrate other means for connecting two forms 10 or 10*a* in an end-to-end fashion. FIG. 24 illustrates a hinge mechanism 100 that includes plates 101,102 connected by a mechanical hinge 103. The plates 101, 102 are received in the C-shaped pocket of two adjacent forms 10 as illustrated schematically in FIG. 25. Accordingly, the forms may be moved from the 180° orientation shown in FIG. 25 to a variety of angular configurations as shown in FIG. 26.

Figure 29:
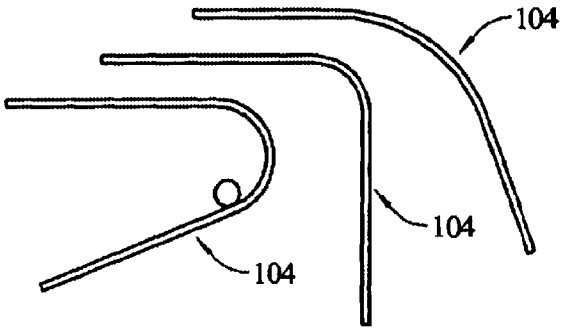
FIG. 29 illustrates the flexibility provided to two adjoining and connected flexible forms that have been connected with the hinge illustrated in FIGS. 27 and 28.

In contrast, a living hinge 104 may be provided to connect two adjacent forms for a curved structure as illustrated schematically in FIG. 29.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A flexible form assembly for forming a concrete structure during drying of the concrete, the flexible form assembly comprising:

an elongated form comprising a front side for engaging the concrete and a rear side, the rear side comprising a back wall disposed between rearwardly extending top and bottom walls, the top wall being connected to a downwardly protruding upper lip, the bottom wall being connected to an upwardly protruding lower lip, the upper and lower lips, the top and bottom walls and the back wall forming a C-shaped pocket for receiving a stake holder, the stake holder comprising right and left flanges that abuttingly engage the back wall, that fit between the top and bottom walls and that are partially disposed between the upper and lower lips and the back wall, the stakeholder further comprising a pocket portion that is connected to and disposed between the right and left flanges, the pocket portion extending outward rearwardly to define an apex which provides a looped pocket for receiving a stake, the front side of the form comprising a front wall that is spaced apart from the back wall, the front and back walls defining a pocket for receiving at least one aluminum reinforcing tube.

2. The flexible form assembly of claim 1 wherein the front and back walls are connected by top and bottom horizontal walls, the front and back walls and top and bottom horizontal walls defining the pocket for receiving the at least one aluminum reinforcing tube.

3. The flexible form assembly of claim 2 wherein the front and back walls are also connected by a middle horizontal wall that is disposed between the top and bottom horizontal walls, the top and middle horizontal walls defining a pocket for receiving a first aluminum reinforcing tube, the bottom and middle horizontal walls defining a pocket for receiving a second aluminum reinforcing tube.

4. The flexible form assembly of claim 2 wherein the front wall is connected to top and bottom front ledges disposed between the top and bottom horizontal walls, the back wall is connected to top and bottom back ledges disposed between the top and bottom horizontal walls, the top front ledge being parallel to and extending towards the top back ledge, the bottom front ledge being parallel to and directed towards the bottom back ledge, the top horizontal wall, the top front ledge and the top back ledge defining a pocket for receiving a first aluminum reinforcing tube, the bottom horizontal wall, the bottom front ledge and the bottom back ledge defining a pocket for receiving a second aluminum reinforcing tube.

5. The flexible form assembly according to claim 1, wherein the form comprises a first form, and including an elongated second form, the second form comprising a front side for engaging the concrete and a rear side, the rear side of the second form comprising a back wall disposed between rearwardly extending top and bottom walls, the top wall of the second form being connected to a downwardly protruding upper lip, the bottom wall of the second form being connected to an upwardly protruding lower lip, the upper and lower lips, the top and bottom walls and the back wall of the second form forming a C-shaped pocket for receiving a connection mechanism, the front side of the second form also comprising a front wall that is spaced apart from the back wall, the first form and the second form each having an open end, the connection mechanism connecting the open end of the first form to the open end of the second form.

6. The flexible form assembly of claim 5 wherein the connection mechanism comprises a first end plug and a second end plug, the first end plug mateably engaging the open end of the first form, the second end plug mateably engaging the open end of the second form, the first end plug comprising an outwardly protruding post and an outwardly protruding cleat, the second end plug comprising a hole for mateably receiving the post of the first end plug and an elongated slot for mateably receiving the cleat of the first end plug.

7. The flexible form assembly of claim 6 wherein the cleat comprises a narrow shaft portion connected to a distal end having an enlarged head, and the elongated slot comprises an enlarged portion for receiving the enlarged head of the cleat and a narrower portion for receiving the shaft portion of the cleat and trapping the enlarged head of the cleat behind the second end plug.

8. The flexible form assembly of claim 5 wherein the connection mechanism comprises a plastic living hinge that is received in the C-shaped pockets of the first and second forms.

9. The flexible form assembly of claim 5 wherein the connection mechanism comprises a hinge comprising a first plate that is received in the C-shaped pocket of the first form and a second plate that is received in the C-shaped pocket of the second form, the first and second plates being hingedly connected together.

10. A flexible form assembly according to claim 1, further including a second elongated form identical to said elongated form and a connection mechanism positioned between an end of said elongated form and an end of said second elongated form.

11. A flexible form assembly according to claim 10, wherein said connection mechanism comprises a first end plug and a second end plug, the first end plug mateably engaging the open end of said elongated form, the second end plug mateably engaging the open end of the second form, the first end plug comprising an outwardly protruding post and an outwardly protruding cleat, the second end plug comprising a hole for mateably receiving the post of the first end plug and an elongated slot for mateably receiving the cleat of the first end plug.

12. The flexible form assembly of claim 11 wherein the cleat comprises a narrow shaft portion connected to a distal end having an enlarged head, and the elongated slot comprises an enlarged portion for receiving the enlarged head of the cleat and a narrower portion for receiving the shaft portion of the cleat and trapping the enlarged head of the cleat behind the second end plug.

13. The flexible form assembly of claim 10 wherein the connection mechanism comprises a plastic living hinge that is received in the C-shaped pockets of the first and second forms.

14. A flexible form assembly for forming a concrete structure during drying of the concrete, the flexible form assembly comprising:

an elongated form comprising a front side for engaging the concrete and a rear side, the rear side comprising a back wall disposed between rearwardly extending top and bottom walls, the top wall being connected to a downwardly protruding upper lip, the bottom wall being connected to an upwardly protruding lower lip, the upper and lower lips, the top and bottom walls and the back wall forming a C-shaped pocket for receiving a stake holder, the stake holder comprising right and left flanges that abuttingly engage the back wall, that fit between the top and bottom walls and that are partially disposed between the upper and lower lips and the back wall, the stakeholder further comprising a pocket portion that is connected to and disposed between the right and left flanges, the pocket portion extending outward rearwardly to define an apex which provides a looped pocket for receiving a stake, the left flange comprising a vertical leg that is connected to the pocket portion and a horizontal leg that extends parallel to the pocket portion and in a spaced apart relationship with the pocket portion, the right flange comprising a vertical leg that is connected to the pocket portion and a horizontal leg that extends parallel to the pocket portion and in a spaced apart relationship with the pocket portion, the horizontal leg of the right flange being disposed opposite the pocket portion from the horizontal leg of the left flange, the horizontal legs of the right and left flanges being biased towards the pocket portion as they frictionally engage the top and bottom walls of the rear side of the form.

15. The flexible form assembly of claim 14 wherein the horizontal leg of the left flange comprises a tapered distal end directed towards a tapered distal end of the vertical leg of the right flange, the horizontal leg of the right flange comprises a tapered distal end directed towards a tapered distal end of the vertical leg of the left flange.

16. The flexible form assembly of claim 14 wherein the pocket portion flexibly connects the horizontal leg of the left flange to the horizontal leg of the right flange.

17. A flexible form assembly for forming a concrete structure during drying of the concrete, the flexible form assembly comprising:

top and bottom elongated forms, each elongated form comprising a front side for engaging the concrete and a rear side, the rear side of each form comprising a back wall disposed between rearwardly extending top and bottom walls, the top wall of each form being connected to a downwardly protruding lower lip, the bottom wall of each form being connected to an upwardly protruding lower lip, the upper and lower lips, the top and bottom walls and the back wall of each form forming a C-shaped pocket for receiving a portion of a stake holder, the top form being stacked on the bottom form so that the front side of the top form is disposed above and flush with respect to the front side of the bottom form, the stake holder comprising an upper portion for slidable connection to the C-shaped pocket of the top form and a lower portion for slidable connection to the C-shaped pocket of the bottom form, the upper and lower portions of the stakeholder each comprising right and left flanges that abuttingly engage the back wall of their respective form, that fit between the top and bottom walls of their respective form and that are partially disposed between the upper and lower lips and the back wall of their respective form, the upper and lower portions of the stakeholder each comprising a pocket portion that is connected to and disposed between its respective right and left flanges, each pocket portion extending outward rearwardly to define an apex which provides a looped pocket for receiving a stake, the pocket portion of upper portion of the stakeholder being in alignment with and connected to the pocket portion of the lower portion of the stakeholder, the front side of each form comprising a front wall that is spaced apart from its respective back wall, the front and back walls of each form defining a pocket for receiving at least one aluminum reinforcing tube.

18. The flexible form assembly of claim 17 wherein the front and back walls of each form are connected by top and bottom horizontal walls, the front and back walls and top and bottom horizontal walls of each form defining the pocket for receiving the at least one aluminum reinforcing tube.

19. The flexible form assembly of claim 18 wherein the front and back walls of each form are also connected by a middle horizontal wall that is disposed between the top and bottom horizontal walls of its respective form, the top and middle horizontal walls of each form defining a pocket for receiving a first aluminum reinforcing tube, the bottom and middle horizontal walls of each form defining a pocket for receiving a second aluminum reinforcing tube.

20. The flexible form assembly of claim 18 wherein the front wall of each form is connected to top and bottom front ledges disposed between the top and bottom horizontal walls of its respective form, the back wall of each form is connected to top and bottom back ledges disposed between the top and bottom horizontal walls of its respective form, the top front ledge of each form being parallel to and extending towards the top back ledge of its respective form, the bottom front ledge being parallel to and directed towards the bottom back ledge of its respective form, the top horizontal wall, the top front ledge and the top back ledge of each form defining a pocket for receiving a first aluminum reinforcing tube, the bottom horizontal wall, the bottom front ledge and the bottom back ledge of each form defining a pocket for receiving a second aluminum reinforcing tube.

* * * * *